US006816040B1

(12) United States Patent
Brown et al.

(10) Patent No.: US 6,816,040 B1
(45) Date of Patent: Nov. 9, 2004

(54) BROADBAND RIGID COAXIAL TRANSMISSION LINE

(75) Inventors: Jeffrey Brown, Windham, ME (US); Gordon Eaton, Raymond, ME (US); John Schadler, Raymond, ME (US)

(73) Assignee: SPX Corporation, Charlotte, NC (US)

( * ) Notice: Subject to any disclaimer, the term of this patent is extended or adjusted under 35 U.S.C. 154(b) by 31 days.

(21) Appl. No.: 10/423,924

(22) Filed: Apr. 28, 2003

(51) Int. Cl.[7] ..... H01P 3/06
(52) U.S. Cl. ..... 333/244; 333/243
(58) Field of Search ..... 333/243, 244, 333/160; 439/586

(56) References Cited

U.S. PATENT DOCUMENTS 2,997,519 A * 8/1961 Hines et al. ..... 174/28
3,391,243 A * 7/1968 Whitehead ..... 174/28
4,614,926 A * 9/1986 Reed et al. ..... 333/244
5,023,594 A * 6/1991 Wallace ..... 340/552
5,167,532 A * 12/1992 Bruno et al. ..... 439/578

* cited by examiner

*Primary Examiner*—Timothy P. Callahan
*Assistant Examiner*—Cassandra Cox
(74) *Attorney, Agent, or Firm*—Baker & Hostetler LLP

(57) ABSTRACT

A broadband coaxial transmission line is formed by joining smaller coaxial transmission lines having particularly formulated lengths. Insulating supports in the transmission line are situated in a prescribed manner to reduce reflections along the transmission line. The insulating supports are also formed with particularly positioned symmetric voids to minimize weight, provide adequate structural support, and minimize reflections.

19 Claims, 6 Drawing Sheets

400

BROADBAND RIGID COAXIAL TRANSMISSION LINE

FIELD OF THE INVENTION

The present invention relates generally to a transmission line. More particularly, the present invention relates to a rigid coaxial transmission line with enhanced broadband capabilities.

BACKGROUND OF THE INVENTION

With the advent of digital television, it has become increasingly important that transmission lines carrying broadcast signals to broadcasts antennas convey the signals with minimal attenuation and signal distortion. Due to zoning constraints, economic, and other pressures, broadcasters have devised upon multiplexing different station signals onto a single broadcast antenna to increase signal throughput. The multiplexing of various broadcast signals onto a single transmission line increases the frequency requirements of the transmission line.

Conventional transmission lines of the broadcast caliber are usually coaxial in nature and very long, being fabricated from joining several smaller coaxial transmission lines together. The joints formed at the junction of the smaller lines unavoidably create flange joints, whereby it is well known that these flange joints generate reflections of the propagating signals in the line. Additionally, to maintain the necessary separation between the inner conductor and the outer conductor of the coaxial line, series of insulating supports are interspersed within the line at specified locations. These insulating supports are usually solid in the form and are also well known to affect the characteristics of the signal and generate reflections along the line.

Therefore, these flange joints and insulating structures detrimentally affect the broadband capabilities of the transmission line. Various attempts have been made in this discipline to mitigate these effects. However, these attempts typically require complicated or significant re-engineering of the transmission line.

Therefore, there has been a long standing need in the transmission line community for a simply configured broadband rigid coaxial transmission line having reduced reflections.

SUMMARY OF THE INVENTION

The foregoing needs are met, to a great extent, by the present invention, wherein difficulties in the prior art are mitigated by using a specially formulated segmentation and a specially shaped insulating support. These and other advantages of the invention are discussed in greater detail below.

In accordance with one embodiment of the present invention, systems and methods for an improved transmission line is provided by joined segments of coaxial transmission lines, the segments having lengths ΔL(n) according to:

$$\Delta L(n)=K((n-1)/N)^{\mu} \text{for } n=1 \ldots N,$$

and $$Lg(n)=L-\Delta L(n) \text{ for } n=1 \ldots N,$$

n being an arbitrary index, N being a total number of line sections in the line run, L being a length of the longest section in the line run, Lg(n) being a length of a segment at index n, and K and $\mu$ being adjustable line constants, where $\mu$ ranges substantially around 1–1.2, and a plurality of insulating supports are arranged within the segments, a first support position a(n) being substantially located according to $$a(n)=A-\Delta L(n)/D,$$

and a second support position b(n) being substantially located according to $$b(n)=B-\Delta L(n)/E,$$

and a third support position c(n) being substantially located according to $$c(n)=C,$$

where A, B, and C are empirically determined constants, and D=2 and E=3.

In accordance with another embodiment of the present invention, a coaxial transmission line insulating support is provided from a cavitied puck of electrically insulating material having sets of rotationally symmetric exterior voids at the perimeter of the puck, the puck having a center conductor hole and sets of rotationally symmetric interior voids, the interior voids being arranged between the center conductor hole and the exterior voids, wherein a centroid of the interior voids are substantially located at the median line between pairs of adjacent exterior voids.

There has thus been outlined, rather broadly, certain embodiments of the invention in order that the detailed description herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
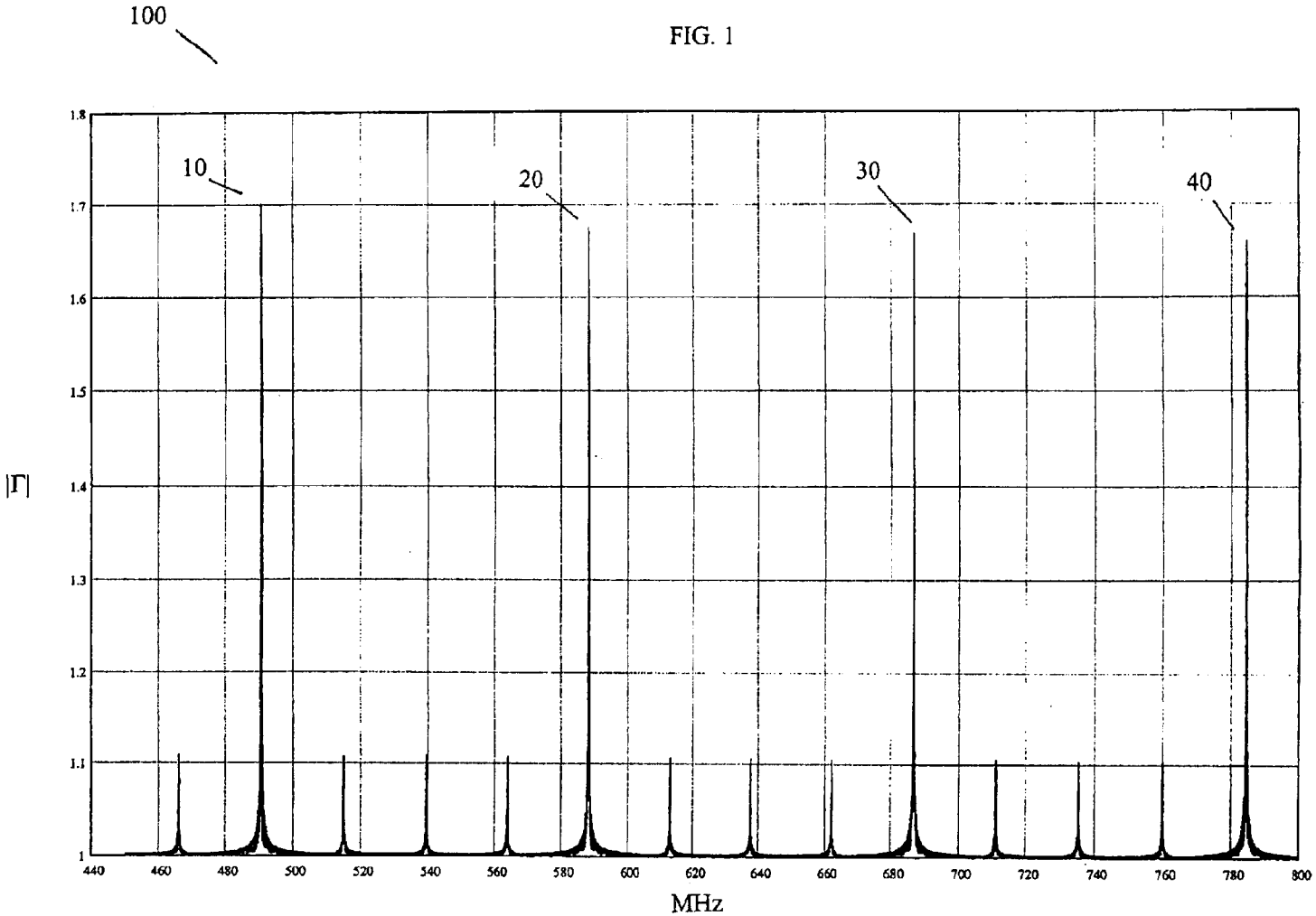
FIG. 1 illustrates the input reflection coefficient response for a conventional narrowband transmission line when excited by a broadband signal.

Conventional rigid coaxial transmission lines are known to suffer from reflections arising from flange joints and the presence of insulating supports. Attempts have been made in the prior art to address these deficiencies by, for example, employing formulated section lengths and reducing the permittivity or size of the insulating supports.

Formulated section lengths are understood to reduce reflections by altering lengths of the transmission line sections in a non-periodic manner. The non-periodicity causes perturbations in the signals to not significantly accumulate or "resonate" as they travel along the line. Several methods for formulating section lengths are available.

One such method, for example, is Grandchamp et al. (U.S. Pat. No. 5,455,548), the contents of which are herein incorporated by reference in its entirety, which describes a formula for optimizing transmission lines section length as $$\Delta L(n)=K((n-1)/N)^{\mu} \text{for } n=1 \ldots N \quad \text{(Eq. 1)}$$

by $$Lg(n)=L-L(n) \text{ for } n=1 \ldots N, \quad \text{(Eq. 2)}$$

wherein n is an arbitrary index, N is the total number of line sections in the line run, L is the length of the longest section in the line run, Lg(n) is the length of a segment at index n, and K and $\mu$ are constants determined to be optimal for the value of L for the range of frequencies over which the line is to operate and the attenuation rate of the line.

Grandchamp et al. in U.S. Pat. No. 5,455,548 has demonstrated a transmission line with reduced reflections for the case of $K=\lambda/2$ and $\mu=1$, where $\lambda$ is the wavelength of the nominally selected frequency. Notwithstanding Grandchamp's enhanced formulation for the section lengths of the transmission line, it is well understood that in addition to the flange joints, reflections are generated by each of the insulating supports which operate to separate the outer conductor from the inner conductor. Even with the supports designed with a nominal permittivity, the quantity of supports over the span of a long run of transmission line can cause reflections to add up at certain frequencies, thereby degrading the overall performance of the transmission line signal. Further exacerbating this problem is the practice of placing the supports at regular points fixed relative to one end of each section.

Conventional attempts to minimize the deleterious affects of the presence of a support structure in a coaxial transmission line have not significantly dealt with altering the permittivity of the support structure. This is due to the fact that permittivity is an inherent property of a subject material, and a large range of materials have already been tested regarding moisture retention, electrical stability, physical strength, durability, etc. Therefore, attempts to reduce the effects of the support structure have been directed to reducing the thickness of the support structure. However, as is well known, the thinner the support structure is the less support it provides. Accordingly, very little to no effort has been expended beyond reducing the thickness of the support structure.

However, it has been demonstrated herein, as an improvement over the prior art, that superior results can be obtained by allowing some of the supports to be shifted relative to certain fixed positions along the transmission line sections depending upon the section length as well as re-structuring the shape of the support. For example, for the case of a section having three supports, the locations can be defined in terms of the quantity $\Delta L$ as defined above. In this instance, the first support is located at $$a(n)=A-\Delta L(n)/D, \quad \text{(Eq. 3)}$$

the second support is located at $$b(n)=B-\Delta L(n)/E, \quad \text{(Eq. 4)}$$

and the third at the fixed point $$c(n)=C, \quad \text{(Eq. 5)}$$

where A, B, and C are fixed locations relative to one end of each section of line. In an exemplary embodiment of this invention, the values have been set to A=17.84 inches, B=102 inches and C=180.5 inches, where D=2 and E=3.

Additionally, an exemplary choice of parameters in the Grandchamp et al. formulation is demonstrated herein to provide an improved input reflection coefficient performance over the transmission line parameters considered "optimal" by Grandchamp et al.

The input reflection coefficient is one of several measurable values in the transmission line art that is used to determine the efficiency of a transmission line. If the input reflection coefficient is 1, then the line is understood to have no reflections and is considered to be optimally operating (less any natural attenuation losses). However, if the input reflection coefficient is over 1, then that portion over the value 1 is considered the fraction of energy that is reflected or not transmitted to the load. The preferred object of transmission line engineering is to design a line with a reflection coefficient as close to 1 as possible.

FIG. 1 is a graph of the measured input reflection coefficient 100 for a typical multi-segmented, multi-supported transmission line terminated with a matched load and excited with a broadband input signal. The segments and supports are of a conventional arrangement, being uniform and evenly spaced. As per standard practice, a pair of supports are placed directly opposing each flange point and individually distributed at equal intervals within the segments. The line is 2000 ft long, has $\mu=1.1$, and contains 100 segments (N). A frequency signal of 450 MHz–800 MHz is injected into the line.

From FIG. 1, it is clearly evident that this transmission line suffers from periodic input reflection coefficient spikes, 10, 20, 30, and 40, having amplitudes in excess of 1.6–1.7. Accordingly, signals with frequencies in the specific domain of these spikes will be significantly reflected. Since the transmission line is terminated with a matched load, the spikes 10, 20, 30, and 40 are well known by one of ordinary skilled in the art as arising from reflections occurring at the various flange joints of the transmission line and the attendant support structures. The high reflection coefficient is indicative of standing waves on the transmission line and highlights the fact that inefficient propagation of the signals of interest is occurring.

Figure 2:
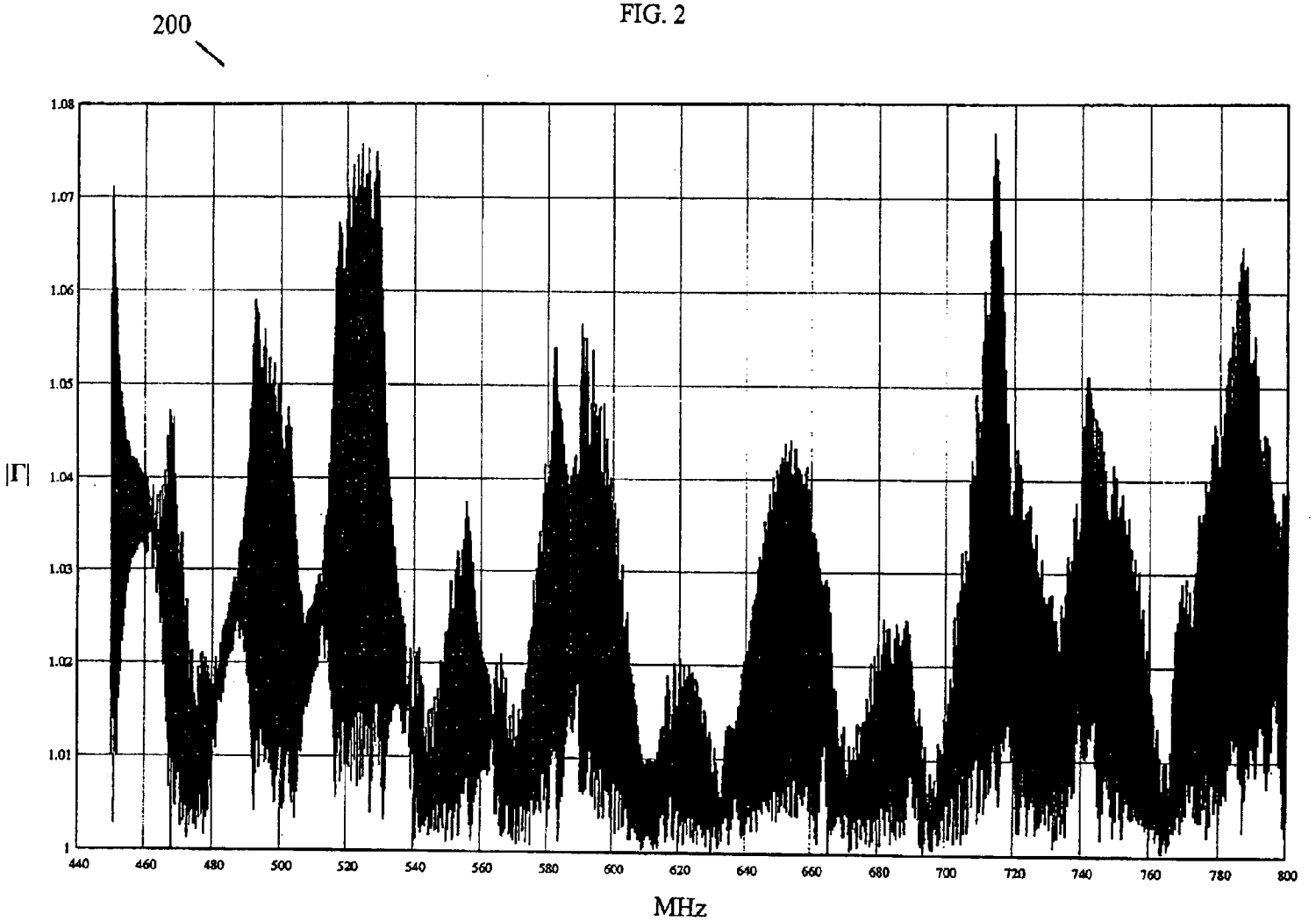
FIG. 2 illustrates the input reflection coefficient response for a transmission line of FIG. 1 with step length sections.

FIG. 2 is a graph illustrating the measured input reflection coefficient 200 for a transmission line of FIG. 1 having stepped sections in accordance with Eqs. 1 and 2 above, with the parameters $K=\lambda/2$ and $\mu=1$ and conventional supports positioned at fixed locations relative to one end of each section. The $K=\lambda/2$ and $\mu=1$ relationship is detailed in Grandchamp et al. as an optimal relationship to reduce the input reflection coefficient.

From FIG. 2, it is obvious that the range of the input reflection coefficients is predominately around 1.04–1.08. Therefore, it is evident that the implementation of stepped sections and fixed positioned supports according to Grandchamp's formulations in the transmission line significantly reduces the amplitude of the reflections as compared to those demonstrated in the transmission line of FIG. 1.

Figure 3:
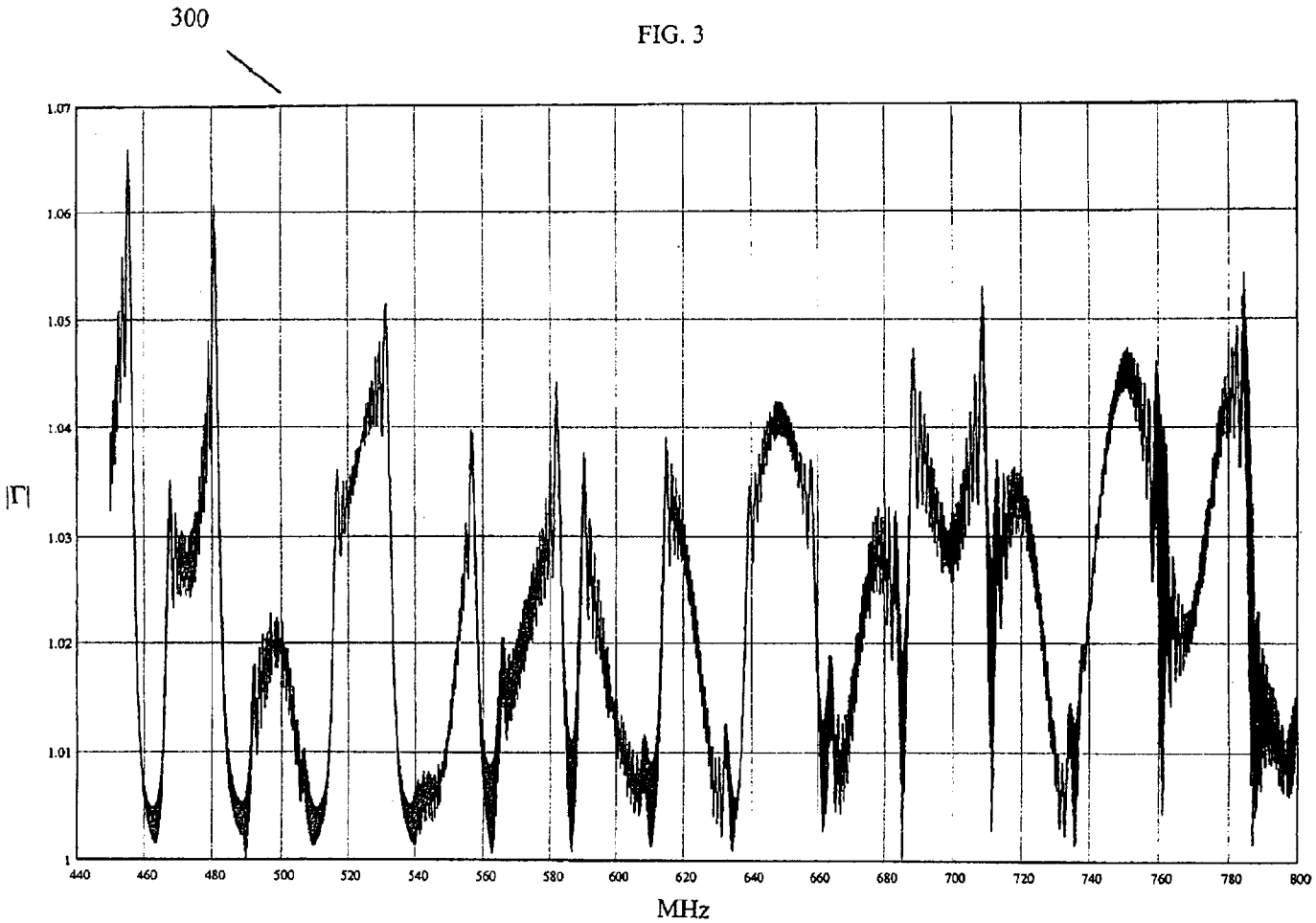
FIG. 3 illustrates the input reflection coefficient response for an exemplary transmission line according to this invention.

FIG. 3 is a graph illustrating the measured input reflection coefficient 300 for an exemplary transmission line having L=20 ft., K=8.2 inches, $\mu$=1, and N=100. Exemplary supports having a particular form (discussed below) are composed of Virgin Teflon® with a thickness of 0.55 inches (at the anchor/flange positions) and 0.25 inches (at the intermediate positions) are situated according to Eqs. 3–5 above, with A=17.84 inches, B=102 inches, and C=180.5 inches, where D=2 and E=3. As is clearly recognizable from FIG. 3, the peaks of the input reflection coefficient are reduced from the peaks seen in FIG. 2. The reduced peaks indicate that less of the signal is reflected and more of the signal is transmitted to the load. Therefore, the examplary positioning of the exemplary supports improves the transmission line response over the prior art.

Figure 4:
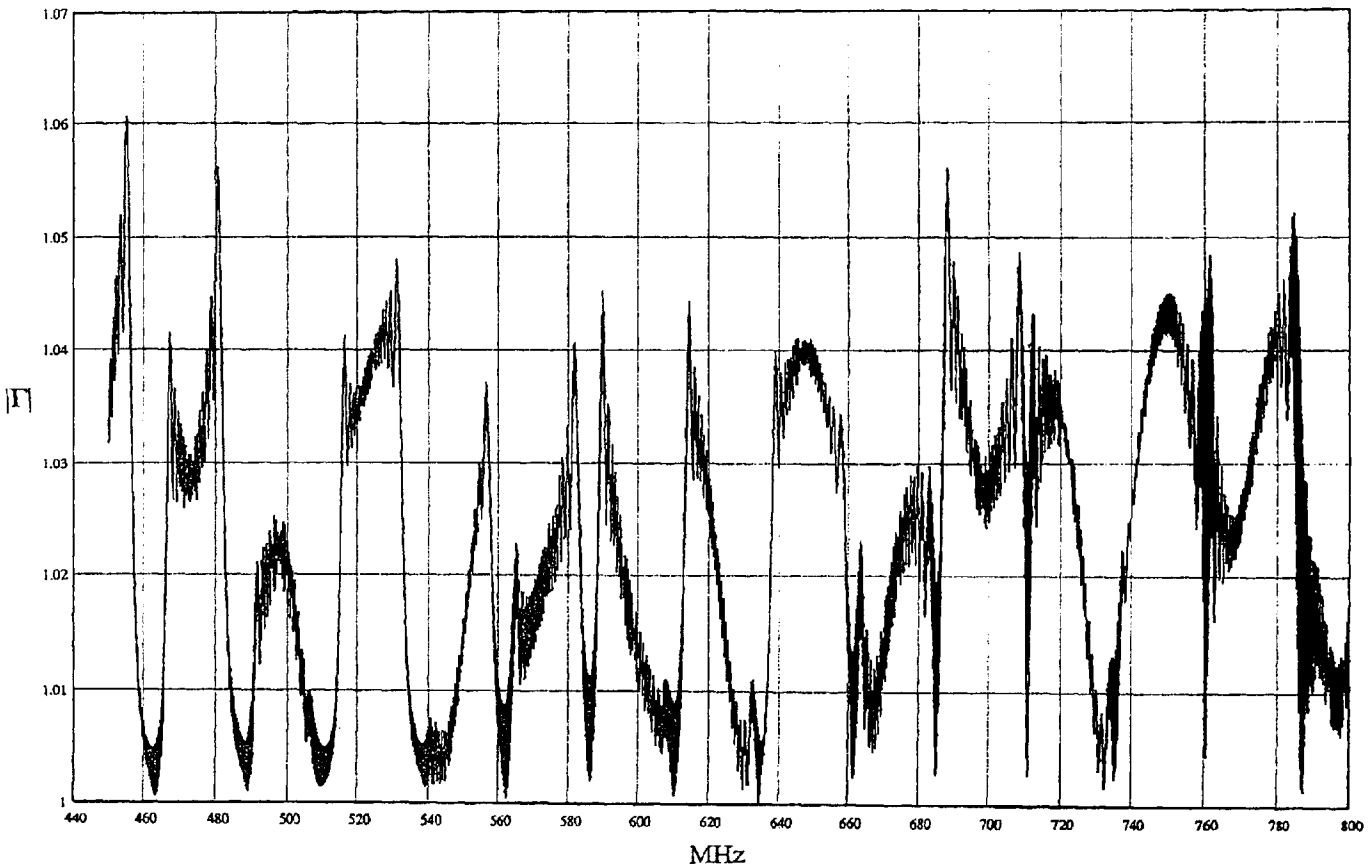
FIG. 4 illustrates the input reflection coefficient response for another exemplary transmission line according to this invention.

FIG. 4 illustrates the input reflection coefficient response 400 for the exemplary transmission line of FIG. 3, wherein $\mu$=1.2. It is recognized that the input reflection coefficient is substantially at or below the levels measured in the transmission line of FIG. 2. Therefore, the exemplary embodiment of FIG. 4 demonstrates an improvement over the prior art.

Figure 5:
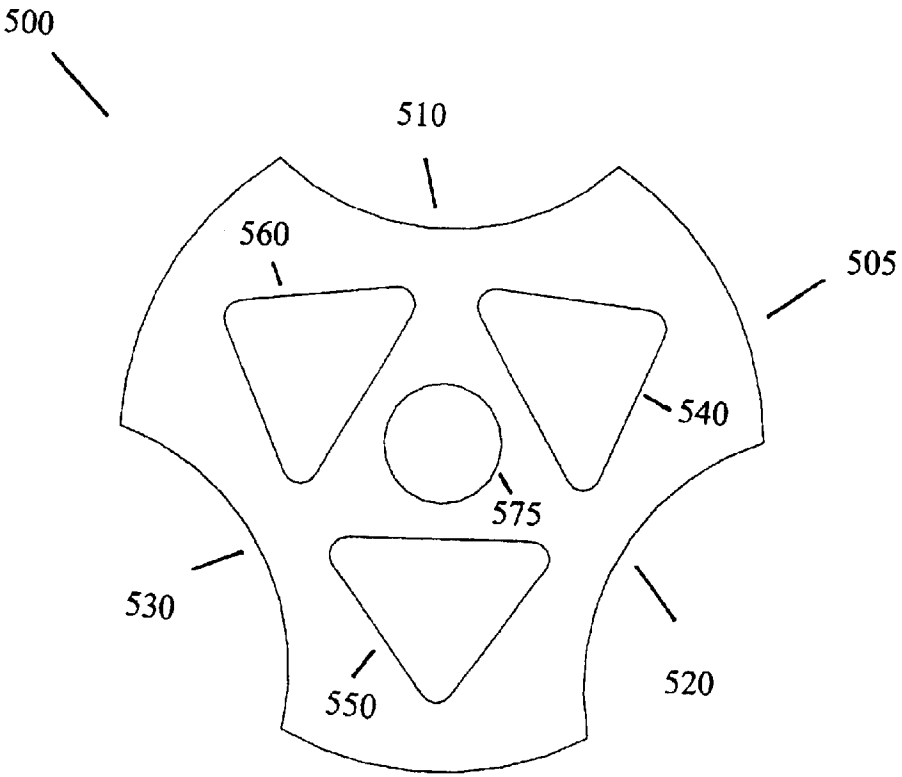
FIG. 5 is a cross-sectional view illustrating the general form of an exemplary support structure of this invention.

FIG. 5 is an illustration of an exemplary support structure 500 according to this invention. The exemplary support structure is formed of an insulating material such as Virgin Teflon® and shaped to provide both adequate structural support and to reduce perturbations of the propagating fields in the coaxial line. The exemplary embodiment is preferably of a cavitied puck-like form 505 having sets of repeating odd-symmetric exterior 510, 520, 530 and interior 540, 550, 560 voids arranged around a center conductor hole 575. The exterior voids 510, 520, 530 may be semi-circular in form, if desired. The interior voids 540, 550, 560 may be semi-triangular in form, if desired. The arrangement of the exterior 510, 520, 530 and interior 540, 550, 560 voids are moderately complementary to provide a sense of symmetry and structural integrity.

The thickness of the exemplary support structure 500 is a function of the dimensions of the transmission line and will accordingly increase as the transmission lines' diameter increases, to provide the added necessary support. For the embodiments used in FIGS. 3 and 4, the thickness were 0.55 inches for an anchor/flange positioned support and 0.25 inches for an intermediate positioned support. The support structure 500 can be formed by molding, casting, evacuating dielectric material according to any of one or more innumerable techniques known to one of ordinary skilled in the art. The general shape of the embodiment of FIG. 5 is to provide a reduced mass insulating structure which minimizes reflections while providing sufficient structural support.

Figure 6:
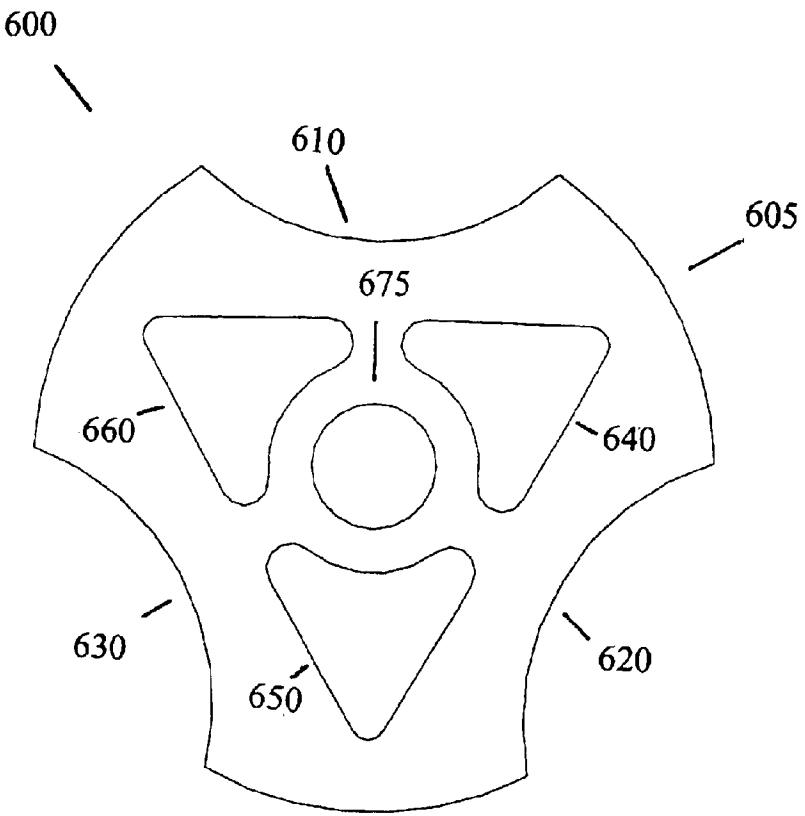
FIG. 6 is a cross-sectional view illustrating another general from an exemplary support structure of this invention.

FIG. 6 is an illustration of another exemplary support structure 600 according to this invention. The structure 600 of FIG. 6 differs from the structure 500 of FIG. 5, principally in that the interior voids 640, 650, 660 have interior sides that are somewhat conforming to the center conductor hole 675. It should be apparent, therefore, that several modifications to the general shape and configuration of the exemplary embodiments may be performed to arrive at the benefits encompassed by this invention, as illustrated, for example, by the modified interior voids 640, 650, 660 of FIG. 6.

Accordingly, while semi-triangular interior voids are shown in the above FIGS., one or more circular, oblong, rectangular, etc. shapes can be used instead of the semi-triangular voids, as desired. Similarly, while the exterior voids are shown with a semi-circular form, alternative shapes may be used as desired. Also, it should be readily apparent that though the principal insulating material used in this invention is Virgin Teflon®, other suitable insulating materials may be used, such as, for example, Duroid®, ceramic, plastic, Styrofoam, etc., as is deemed suitable by one of ordinary skill in the art.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A coaxial transmission line insulating support, comprising:

a cavitied puck of electrically insulating material;

sets of rotationally symmetric exterior voids at a perimeter of the puck;

a center conductor hole; and sets of rotationally symmetric interior voids in the puck, arranged between the center conductor hole and the exterior voids, wherein a centroid of the interior voids are substantially located at a median line between pairs of adjacent exterior voids.

2. The insulating support of claim 1, wherein the interior voids are semi-triangular in form, the interior voids being oriented to be substantially bisected by imaginary radial lines from a center of the transmission line, passing through the interior voids' centroid.

3. The insulating support of claim 2, wherein an innermost contour of the interior voids is semi-circular.

4. The insulating support of claim 2, wherein the exterior voids are semi-circular.

5. The insulating support of claim 2, wherein the interior and exterior voids form odd sets.

6. The insulating support of claim 2, wherein the interior and exterior voids form even sets.

7. An insulating supporting means for a broadband transmission line, comprising:

an electrically insulating means formed in the shape of a cavitied puck, wherein voids of (a) sets of rotationally symmetric exterior voids are located substantially at a perimeter of the electrically insulating means, (b) a center void is located substantially at the center of the electrically insulating means; and (c) sets of rotationally symmetric interior voids are located substantially between the center void and the exterior voids, wherein a centroid of the interior voids are substantially located at a median line between pairs of adjacent exterior voids.

8. The insulating supporting means according to claim 7, wherein the interior voids are semi-triangular in form, the interior voids being oriented to be substantially bisected by imaginary radial lines from a center of the broadband transmission line, passing through the interior voids' centroid.

9. The insulating supporting means according to claim 8, wherein an innermost contour of the interior voids is semi-circular.

10. The insulating supporting means according to claim 7, wherein the exterior voids are semi-circular.

11. The insulating supporting means according to claim 7, wherein the interior and exterior voids form odd sets.

12. The insulating supporting means according to claim 7, wherein the interior and exterior voids form even sets.

13. A broadband transmission line comprising:

joined segments of coaxial transmission lines, the segments having lengths ΔL(n) according to:

$$\Delta L(n)=K((n-1)/N)^{\mu} \text{for } n=1 \ldots N,$$

and $$Lg(n)=L-\Delta L(n) \text{ for } n=1 \ldots N,$$

n being an arbitrary index, N being a total number of line sections in a line run, L being a length of a longest section in the line run, Lg(n) being a length of a segment at index n, and K and $\mu$ being adjustable line constants, where $\mu$ ranges substantially around 1–1.2; and a plurality of insulating supports arranged within the segments, a first support position a(n) being substantially located according to $$a(n)=A-\Delta L(n)/D,$$

and a second support position b(n) being substantially located according to $$b(n)=B-\Delta L(n)/E,$$

and a third support position c(n) being substantially located according to $$c(n)=C,$$

where A, B, and C are empirically determined constants, and D and E are integer constants.

14. The broadband transmission line of claim 13, wherein D=2 and E=3.

15. The broadband transmission line according to claim 13, wherein the insulating support is comprised of:

a cavitied puck of electrically insulating material;

sets of rotationally symmetric exterior voids at a perimeter of the puck;

a center conductor hole; and sets of rotationally symmetric interior voids in the puck, arranged between the center conductor hole and the exterior voids, wherein a centroid of the interior voids are substantially located at a median line between pairs of adjacent exterior voids.

16. A broadband electrical signal transmitting means, comprising:

joined segments of smaller electrical signal transmitting means, the segments having lengths ΔL(n) according to:

$$\Delta L(n)=K((n-1)N)^{\mu} \text{for } n=1 \ldots N,$$

and $$Lg(n)=L-L)(n) \text{ for } n=1 \ldots N,$$

n being an arbitrary index, N being a total number of line sections in a line run, L being a length of a longest section in the line run, Lg(n) being a length of a segment at index n, and K and $\mu$ being adjustable line constants, where $\mu$ ranges substantially around 1–1.2; and insulating supporting means, arranged within the segments of the smaller electrical transmitting means, a first support position a(n) being substantially located according to $$a(n)=A-\Delta L(n)/D,$$

and a second support position b(n) being substantially located according to $$b(n)=B-\Delta L(n)/E,$$

and a third support position c(n) being substantially located according to $$c(n)=C,$$

where A, B, and C are empirically determined constants, and D and E are integer constants.

17. The broadband electrical signal transmitting means of claim 16, wherein D=2 and E=3.

18. A method for forming a broadband transmission line, comprising the steps of:

joining segments of coaxial transmission lines, the segments having lengths ΔL(n) according to:

$$\Delta L(n)=K((n-1)/N)^{\mu} \text{for } n=1 \ldots N,$$

and $$Lg(n)=L-\Delta L(n) \text{ for } n=1 \ldots N,$$

n being an arbitrary index, N being a total number of line sections in a line run, L being a length of a longest section in the line run, Lg(n) being a length of a segment at index n, and K and $\mu$ being adjustable line constants, where $\mu$ ranges substantially around 1–1.2; and arranging a plurality of insulating supports within the segments, a first support position a(n) being substantially located according to $$a(n)=A-\Delta L(n)/D,$$

and a second support position b(n) being substantially located according to $$b(n)=B-\Delta L(n)/E,$$

and a third support position c(n) being substantially located according to $$c(n)=C,$$

where A, B, and C are empirically determined constants, and D and E are integer constants.

19. The method for forming a broadband transmission line, according to claim 18, further comprising the step of setting D=3 and E=4.

* * * * *